US010837258B2

(12) United States Patent
Kræmer

(10) Patent No.: US 10,837,258 B2
(45) Date of Patent: Nov. 17, 2020

(54) DOWNHOLE COMPLETION SYSTEM

(71) Applicant: WELLTEC OILFIELD SOLUTIONS AG, Zug (CH)

(72) Inventor: Jon Kræmer, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 21 days.

(21) Appl. No.: 16/425,043

(22) Filed: May 29, 2019

(65) Prior Publication Data

US 2019/0368309 A1 Dec. 5, 2019

(30) Foreign Application Priority Data

May 30, 2018 (EP) ..... 18175167

(51) Int. Cl.

| | |
|---|---|
| ***E21B 34/10*** | (2006.01) |
| ***E21B 33/127*** | (2006.01) |
| ***E21B 34/14*** | (2006.01) |

(52) U.S. Cl.

CPC ..... *E21B 34/10* (2013.01); *E21B 33/127* (2013.01); *E21B 34/14* (2013.01); *E21B 2200/06* (2020.05)

(58) Field of Classification Search

CPC ..... E21B 34/10; E21B 34/102; E21B 34/14; E21B 34/142; E21B 2200/06

See application file for complete search history.

(56) References Cited

U.S. PATENT DOCUMENTS 3,878,889 A * 4/1975 Seabourn ..... E21B 34/14 166/360
4,574,894 A * 3/1986 Jadwin ..... E21B 21/103 175/317

(Continued)

FOREIGN PATENT DOCUMENTS

EP 2 813 669 12/2014

OTHER PUBLICATIONS

Extended Search Report for EP18175167.8 dated Dec. 11, 2018, 8 pages.

*Primary Examiner* — D. Andrews
(74) *Attorney, Agent, or Firm* — Nixon & Vanderhye P.C.

(57) ABSTRACT

The present invention relates to a downhole completion system for providing a well tubular metal structure in a borehole of a well having a top, comprising a well tubular metal structure configured to be arranged in the borehole. The well tubular metal structure having a first end nearest the top and a second end, and at least one annular barrier having a tubular metal part mounted as part of the well tubular metal structure, an expandable metal sleeve surrounding the tubular metal part, each end of the expandable metal sleeve being connected with the tubular metal part defining an annular barrier space, and an expansion opening in the tubular metal part for letting fluid into the annular barrier space to expand the sleeve, and wherein the downhole completion system further comprises a closing unit configured to be in a first position to allow flow through the second end and configured to be in a second position to close the second end, the closing unit comprises a tubular unit part having a first unit end being open and a second unit end being closed, a sliding sleeve arranged on an outer face of the tubular unit part defining a chamber, at least one first opening in the tubular unit part, at least one second opening in the tubular unit part opposite the chamber, the at least one (Continued)

Figure 1:
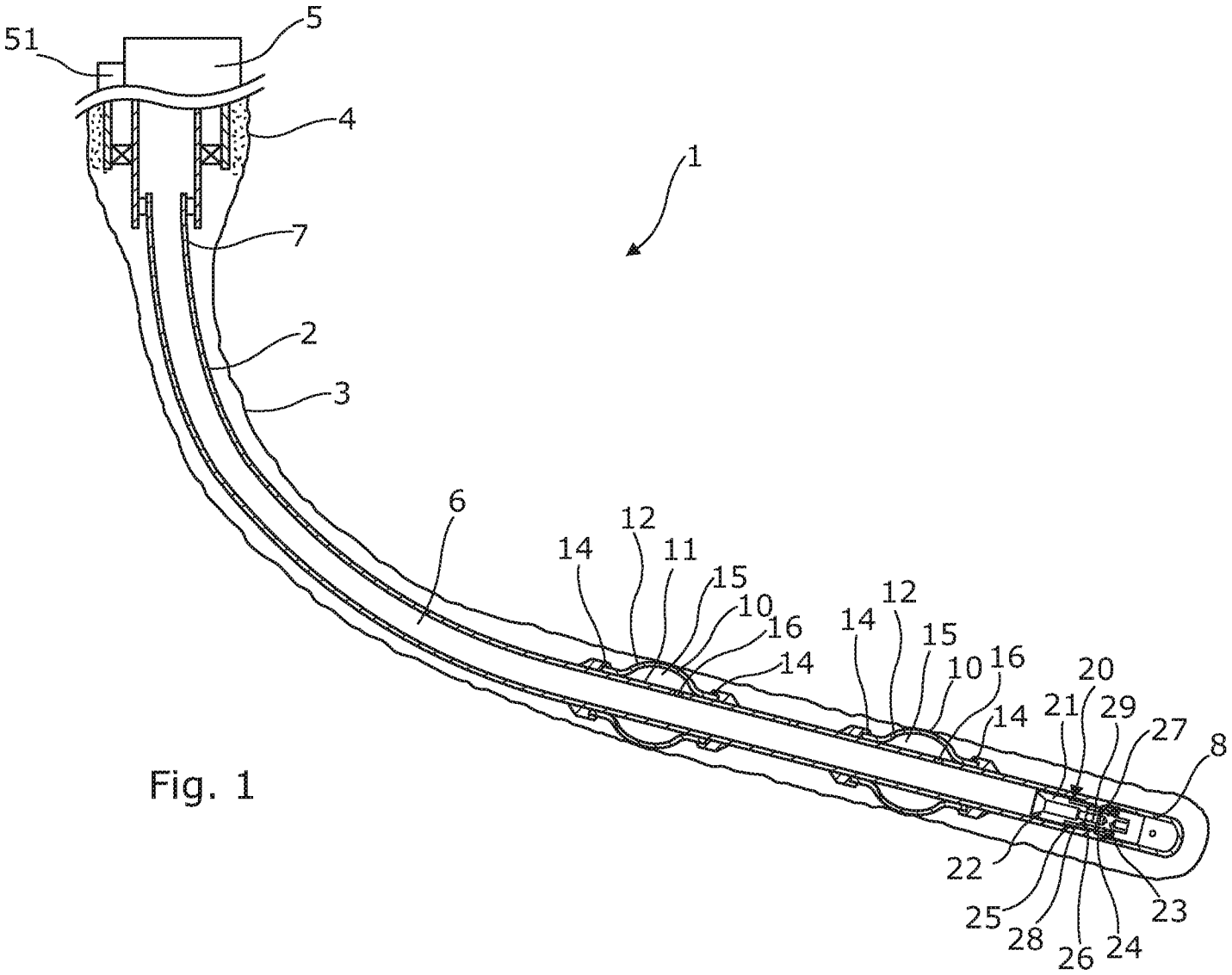

second opening is arranged closer to the first unit end than the at least one first opening, and a ball seat arranged in the tubular unit part between the at least one first opening and the at least one second opening. The invention also relates to a closing unit configured to be in a first position to allow flow through a second end of a well tubular metal structure downhole and configured to be in a second position to close the second end.

15 Claims, 5 Drawing Sheets

(56) References Cited

U.S. PATENT DOCUMENTS

| | | | | |
|---|---|---|---|---|
| 2004/0084182 | A1 | 5/2004 | Edgar et al. | |
| 2015/0300154 | A1* | 10/2015 | Hallundb K | E21B 33/127 166/250.17 |

* cited by examiner

DOWNHOLE COMPLETION SYSTEM

This application claims priority to EP Patent Application No. 18175167.8 filed May 30, 2018, the entire contents of which are hereby incorporated by reference.

The present invention relates to a downhole completion system for providing a well tubular metal structure in a borehole of a well having a top. The invention also relates to a closing unit.

In a downhole completion system, the casing or liner is run in hole with the end open to enable flow-through and to equalise pressure between the inside of the casing/liner and the well and in order to circulate and clean out mud and the like. After circulation, the end of the casing/liner needs to be closed in order to pressurise the casing/liner to e.g. set packers, barriers, or move sleeves to open for production. In order to close the end of the casing/liner, a ball is often dropped but the ball seat may not be sufficiently clean, and therefore fluid is still able to pass between the ball and the ball seat. Another solution entails a ball seated in a sliding sleeve and upon a pressure increase, the sleeve moves to a closed position. However, these known sleeves tend to get stuck due to dirt and other elements in the well and then the end is not closed properly.

It is an object of the present invention to wholly or partly overcome the above disadvantages and drawbacks of the prior art. More specifically, it is an object to provide an improved downhole completion system which can provide flow-through when run in hole while also providing a reliable closing subsequently, even though mud and other dirt is flushed through the opening in the end.

The above objects, together with numerous other objects, advantages and features, which will become evident from the below description, are accomplished by a solution in accordance with the present invention by a downhole completion system for providing a well tubular metal structure in a borehole of a well having a top, comprising:

a well tubular metal structure configured to be arranged in the borehole, the well tubular metal structure having a first end nearest the top and a second end, at least one annular barrier having:

- a tubular metal part mounted as part of the well tubular metal structure,
- an expandable metal sleeve surrounding the tubular metal part, each end of the expandable metal sleeve being connected with the tubular metal part defining an annular barrier space, and
- an expansion opening in the tubular metal part for letting fluid into the annular barrier space to expand the sleeve, and wherein the downhole completion system further comprises a completion closing unit configured to be in a first position to allow flow through the second end and configured to be in a second position to close the second end, the closing unit comprising:

- a tubular unit part having a first unit end being open and a second unit end being closed,
- a sliding sleeve arranged on an outer face of the tubular unit part defining a chamber,
- at least one first opening in the tubular unit part,
- at least one second opening in the tubular unit part opposite the chamber, the at least one second opening is arranged closer to the first unit end than the at least one first opening, and
- a ball seat arranged in the tubular unit part between the at least one first opening and the at least one second opening.

The sliding sleeve in the first position may uncover the at least one first opening and the sliding sleeve in the second position may cover the at least one first opening.

Furthermore, the sliding sleeve may move from the first position to the second position by means of fluid entering the chamber, which increases as the sliding sleeve moves away from the first unit end.

Also, the sliding sleeve may function as a piston.

Moreover, the closing unit may comprise at least one shear pin for maintaining the sleeve in the first position until a predetermined pressure.

In addition, the outer face at the second unit end may comprise circumferential grooves engaging a pawl of an end part of the sliding sleeve in the form of a ratchet system.

Further, the sliding sleeve may comprise an opening which in the first position is aligned with the at least one first opening in the tubular unit part.

The closing unit may further comprise a first sealing means and a second sealing means arranged between the sliding sleeve and the tubular unit part on each side of the at least first opening, and a third sealing means arranged between the sliding sleeve and the tubular unit part between the first unit end and the at least second opening.

The downhole completion system according to the present invention, may further comprise a unit housing surrounding the tubular unit part and the sliding sleeve, in order that the sliding sleeve slides between the unit housing and the tubular unit part.

The downhole completion system as described above may further comprise an end cap having apertures and being connected to the unit housing.

Moreover, the unit housing may comprise a projection on an inner face for receiving a flange of the tubular unit part in order that the tubular unit part is hindered from movement past the projection.

Also, the tubular unit part may have a third unit section having a third outer diameter being greater than the second outer diameter.

In addition, the third outer diameter may be greater than the outer diameter of the second sleeve part creating space for the second sleeve part to be allowed to slide.

Furthermore, the second sleeve part may be allowed to slide until reaching the projection.

Moreover, the outer diameter of the first sleeve part may be smaller than the inner diameter of the projection in order that the first sleeve part is allowed to freely slide past the projection.

Furthermore, the at least one second opening may have a diameter smaller than that of the at least one first opening.

Further, the sliding sleeve may have a first sleeve part having a first inner sleeve diameter and a second sleeve part having a second inner sleeve diameter, the tubular unit part having a first unit section, having a first outer diameter corresponding to the first inner sleeve diameter and a second unit section of the tubular unit part having a second outer diameter corresponding to the second inner sleeve diameter.

Additionally, the tubular unit part may have a decreasing inner diameter at the first unit end for guiding a ball towards the ball seat.

Also, the tubular unit part may be mounted within the unit housing.

Moreover, the downhole completion system may further comprise a pumping unit for generating an increased pressure inside the well tubular metal structure to move the sliding sleeve from the first position to the second position.

In addition, the well tubular metal structure may be hung-off from a casing, e.g. a surface casing.

Finally, the present invention relates to a closing unit configured to be in a first position to allow flow through a second end of a well tubular metal structure downhole and configured to be in a second position to close the second end, the closing unit comprises:

- a tubular unit part having a first unit end being open and a second unit end being closed,
- a sliding sleeve arranged on an outer face of the tubular unit part defining a chamber,
- at least one first opening in the tubular unit part,
- at least one second opening in the tubular unit part opposite the chamber, the at least one second opening is arranged closer to the first unit end than the at least one first opening, and
- a ball seat arranged in the tubular unit part between the at least one first opening and the at least one second opening.

Figure 2A:
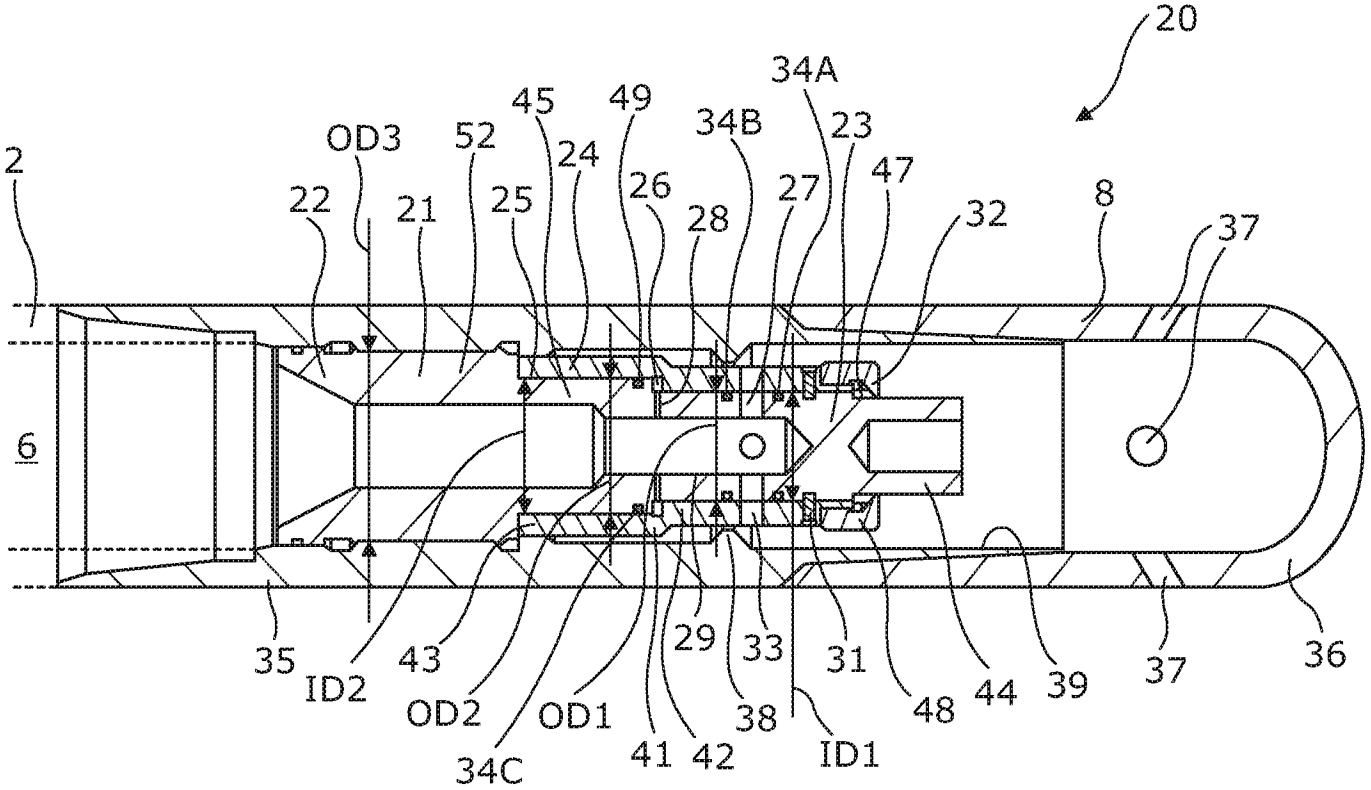
Figure 2B:
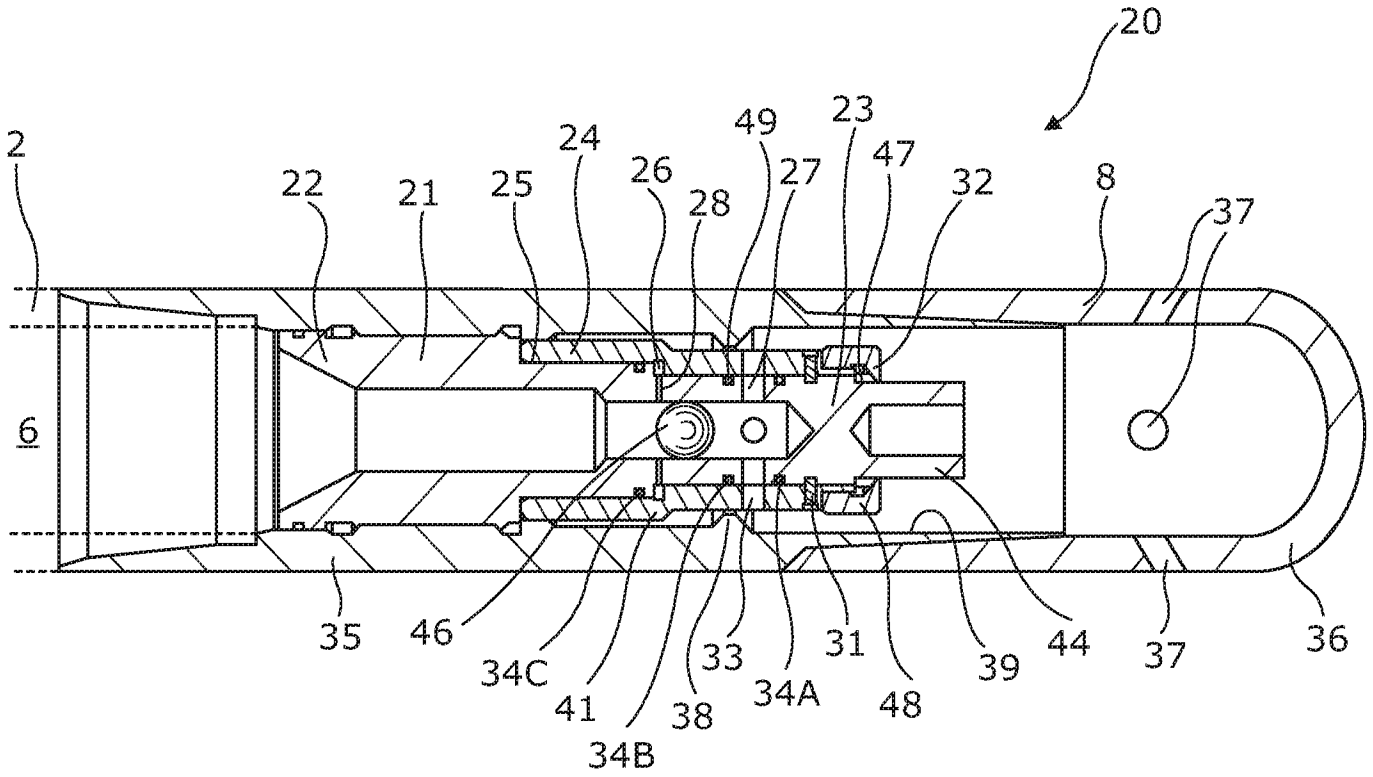
Figure 2C:
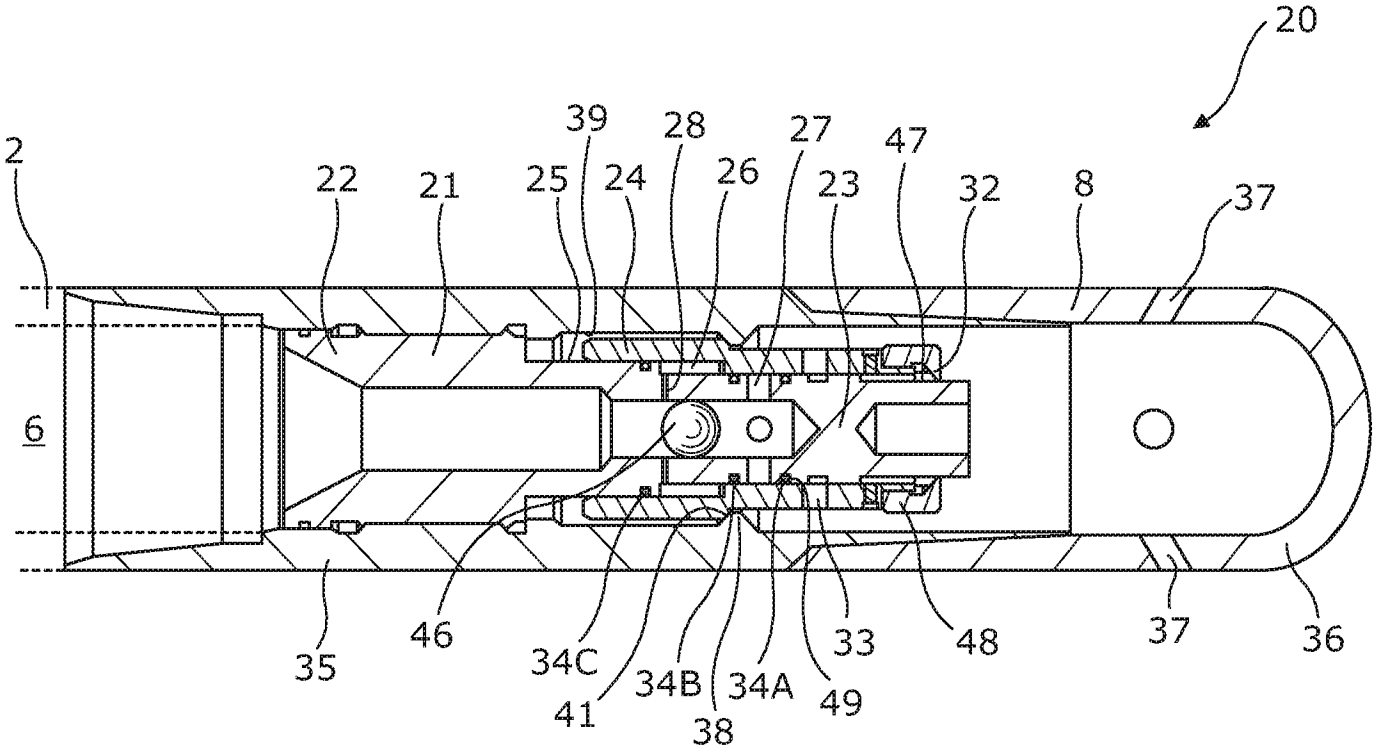
Figure 3:
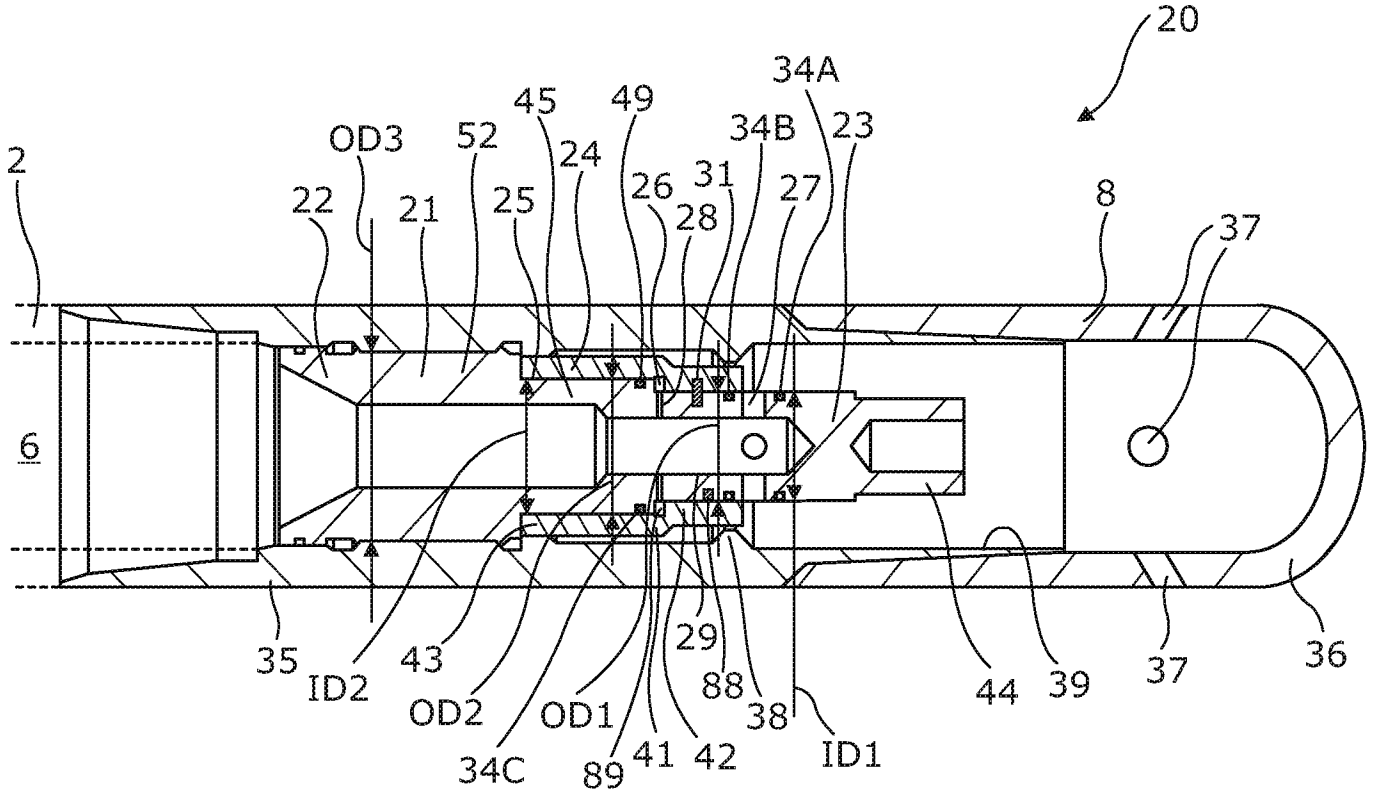

The invention and its many advantages will be described in more detail below with reference to the accompanying schematic drawings, which for the purpose of illustration show some non-limiting embodiments and in which:

FIG. 1 shows a partly cross-sectional view of a downhole completion system,

FIG. 2A is a cross-sectional view of a closing unit in its first and open position, FIG. 2B is a cross-sectional view of the closing unit of FIG. 2A in its first position in which a ball hinders free flow, and FIG. 2C is a cross-sectional view of the closing unit of FIG. 2A in its second and closed position, and FIG. 3 is a cross-sectional view of another closing unit in its first and open position.

All the figures are highly schematic and not necessarily to scale, and they show only those parts which are necessary in order to elucidate the invention, other parts being omitted or merely suggested.

FIG. 1 shows a downhole completion system 1 having a well tubular metal structure 2 in a borehole 3 of a well 4 having a top 5. The well tubular metal structure has a first end 7 nearest the top and a second end 8 closer to the bottom of the borehole. The downhole completion system further comprises two annular barriers 10, each annular barrier comprising a tubular metal part 11 mounted as part of the well tubular metal structure, an expandable metal sleeve 12 surrounding the tubular metal part. Each end 14 of the expandable metal sleeve is connected with the tubular metal part defining an annular barrier space 15. An expansion opening 16 is provided in the tubular metal part for letting fluid from the well tubular metal structure into the annular barrier space to expand the sleeve. The downhole completion system further comprises a completion closing unit 20, which in a first position (shown in FIG. 2A) is configured to allow flow through the second end and in a second position (shown in FIG. 2C) is configured to close the second end. The closing unit comprises a tubular unit part 21 having a first unit end 22 being open and in fluid communication with the inside 6 of the well tubular metal structure.

As shown in FIG. 2A, the tubular unit part has a second unit end 23 which is closed. The completion closing unit further comprises a sliding sleeve 24 arranged on an outer face 25 of the tubular unit part defining a chamber 26 there between. The tubular unit part further comprises at least one first opening 27 and at least one second opening 28 arranged opposite the chamber. The at least one second opening is arranged closer to the first unit end than the at least one first opening. The closing unit further comprises a ball seat 29 arranged in the tubular unit part between the at least one first opening and the at least one second opening. When the well tubular metal structure is run in hole, the closing unit is in its first position allowing flow-through, i.e. that the well fluid surrounding the well tubular metal structure is allowed to enter the second end of the well tubular metal structure through apertures 37 in an end cap 36. The sliding sleeve cannot be stuck as in the prior art solutions, since the sliding sleeve slides on the outer face of the tubular unit part 21 and not on the inner face where particles from the mud can accumulate in the bottom hindering the sliding sleeve from sliding. If any particles have accumulated on the outer face of the tubular unit part 21, the sleeve merely pushes any elements away from the outer face of the tubular unit part 21 as the sleeve slides towards the second position.

Thus in the first position, the sliding sleeve uncovers the first opening, and in the second position, the sliding sleeve covers the first opening and thereby closes the end of the well tubular metal structure. The sliding sleeve moves from the first position to the second position by means of fluid entering the chamber 26 through the second opening 28 and presses onto the sliding sleeve, increasing the chamber as the sliding sleeve moves away from the first unit end 22 towards the second unit end 23. Thus, the sliding sleeve functions as a piston.

As can be seen in FIGS. 2A and 2B, the completion closing unit comprises a shear pin 31 for maintaining the sliding sleeve in the first position until a predetermined pressure is reached on the inside 6 of the well tubular metal structure and presses onto the sliding sleeve, breaking the shear pin and thus, the sliding sleeve starts to move to the second position, as shown in FIG. 2C.

In order to prevent the completion closing unit from returning to the first position but still remain closed, the outer face at the second unit end comprises circumferential grooves 47 engaging a pawl 32 of an end part 48 of the sliding sleeve in the form of a ratchet system. In another embodiment, collets may be released as the sliding sleeve moves and the collets falling into the space created behind the sliding sleeve as it moves towards the second position, thus hindering the sliding sleeve from returning to the first position.

In FIG. 2A, the sliding sleeve may comprise an opening 33 which in the first position is aligned with the first opening 27 in the tubular unit part 21 and thus uncovers the first opening. In another embodiment, the sliding sleeve does not overlap the first opening 27 in the first position but covers the first opening in the second position.

In order to properly seal off the first opening, the completion closing unit 20 further comprises a first sealing means 34A and a second sealing means 34B arranged between the sliding sleeve 24 and the tubular unit part 21 on each side of the first opening. In FIG. 2A, the first sealing means 34A and the second sealing means 34B are arranged in circumferential grooves 49 in the tubular unit part 21. In order to provide a reliable sliding of the sliding sleeve 24, the closing unit 20 further comprises a third sealing means 34C arranged between the sliding sleeve 24 and the tubular unit part 21 between the first unit end 22 and the second opening 28.

In FIGS. 2A-2C, the downhole completion system further comprises a unit housing 35 surrounding the tubular unit part 21 and the sliding sleeve 24 so that the sliding sleeve slides between the unit housing 35 and the tubular unit part 21.

The unit housing may comprise a projection 38 on an inner face 39 for receiving a flange 41 of the tubular unit part, so that the tubular unit part 21 is hindered from movement past the projection 38 and past the first opening 27. In this way, it is ensured that the sliding sleeve does not slide too far, and thus it is ensured that it uncovers the first opening 27 again. As can be seen in FIGS. 2A-2C, the second opening has a diameter smaller than that of the at least one first opening.

The sliding sleeve has a first sleeve part 42 having a first inner sleeve diameter ID1 and a second sleeve part 43 having a second inner sleeve diameter ID2, and the tubular unit part 21 has a first unit section 44 having a first outer diameter OD1 corresponding to the first inner sleeve diameter ID1 and a second unit section 45 of the tubular unit part 21 has a second outer diameter OD2 corresponding to the second inner sleeve diameter ID2. The first inner sleeve diameter is smaller than the second inner sleeve diameter providing a possibility for creating the chamber.

The tubular unit part 21 has a third unit section 52 having a third outer diameter OD3 being greater than the second outer diameter OD2. The third outer diameter OD3 being greater than the outer diameter of the second sleeve part 43 creating space for the second sleeve part to be allowed to slide until reaching the projection 38. The outer diameter of the first sleeve part 42 is smaller than the inner diameter of the projection, so that the first sleeve part 42 is allowed to freely slide past the projection.

The tubular unit part may have a decreasing inner diameter from the open end at the first unit end towards the ball seat for guiding a ball 46 towards the ball seat.

The tubular unit part may be mounted within the unit housing as shown in FIGS. 2A-2C, but in another embodiment, the unit housing and the tubular unit part are combined into one part, having an elongated groove in which the sliding sleeve slides. The closing unit may function without the unit housing or without an outer part surrounding the sliding sleeve 24 as the sleeve just pushes any elements away from the outer face of the tubular unit part 21 when the sleeve slides towards the second position.

The completion closing unit is in a first position configured to allow flow through a second end of a well tubular metal structure downhole and in a second position configured to close the second end. The closing unit is mounted as part of the well tubular metal structure in the end thereof. The closing unit 20 thus comprises the tubular unit part 21 having the first unit end 22 being open and the second unit end 23 being closed. The sliding sleeve 24 is arranged on the outer face 25 of the tubular unit part defining a chamber 26 between the sleeve and the tubular unit part. The closing unit 20 further comprises the first opening 27 and the second opening 28 in the tubular unit part, where the second opening is arranged closer to the first unit end than the first opening. The closing unit 20 further comprises the ball seat 29 arranged in the tubular unit part between the first opening and the second opening so that fluid is led into the second opening for moving the sliding sleeve.

In FIG. 3, the sliding sleeve 24 of the completion closing unit does not comprise an opening 33 in that the sliding sleeve is not long enough to cover the opening 27 when the sliding sleeve is in its initial position i.e. before the chamber 26 is pressurised breaking the shear pin 31. The tubular unit part has an indentation in which a spring-loaded element 88 is arranged, so that when the sliding sleeve slides to cover the opening 27, the spring-loaded element projects radially into the chamber 26, preventing the sliding sleeve from returning as the projected spring-loaded element 88 engages edge 89 of the tubular unit part 21.

The downhole completion system may comprise a pumping unit 51 arranged at the top 5, as shown in FIG. 1, for generating an increased pressure inside the well tubular metal structure in order to move the sliding sleeve 24 from the first position to the second position. The increased pressure may also be created by submerging a tool into the well tubular metal structure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, liner or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system for providing a well tubular metal structure in a borehole of a well having a top, comprising:

a well tubular metal structure configured to be arranged in the borehole, the well tubular metal structure having a first end nearest the top and a second end, at least one annular barrier having:

a tubular metal part mounted as part of the well tubular metal structure, an expandable metal sleeve surrounding the tubular metal part, each end of the expandable metal sleeve being connected with the tubular metal part defining an annular barrier space, and an expansion opening in the tubular metal part for letting fluid into the annular barrier space to expand the sleeve, and wherein the downhole completion system further comprises a completion closing unit having a first position allowing flow through the second end and a second position in which the second end is closed, the closing unit comprising:

a tubular unit part having a first unit end being open and a second unit end being closed, a sliding sleeve arranged on an outer face of the tubular unit part defining a chamber, at least one first opening in the tubular unit part, at least one second opening in the tubular unit part opposite the chamber, the at least one second opening is arranged closer to the first unit end than the at least one first opening, and a ball seat arranged in the tubular unit part between the at least one first opening and the at least one second opening.

2. A downhole completion system according to claim 1, wherein the sliding sleeve in the first position uncovers the at least one first opening and the sliding sleeve in the second position covers the at least one first opening.

3. A downhole completion system according to claim 1 or 2, wherein the sliding sleeve moves from the first position to the second position by means of fluid entering the chamber, which increases as the sliding sleeve moves away from the first unit end.

4. A downhole completion system according to claim 1, wherein the closing unit comprises at least one shear pin for maintaining the sleeve in the first position until a predetermined pressure.

5. A downhole completion system according to claim 1, wherein the outer face at the second unit end comprises circumferential grooves engaging a pawl of an end part of the sliding sleeve in the form of a ratchet system.

6. A downhole completion system according to claim 1, wherein the sliding sleeve comprises an opening which in the first position is aligned with the at least one first opening in the tubular unit part.

7. A downhole completion system according to claim 1, wherein the closing unit further comprises a first sealing means and a second sealing means arranged between the sliding sleeve and the tubular unit part on each side of the at least first opening, and a third sealing means arranged between the sliding sleeve and the tubular unit part between the first unit end and the at least second opening.

8. A downhole completion system according to claim 1, further comprising a unit housing surrounding the tubular unit part and the sliding sleeve, in order that the sliding sleeve slides between the unit housing and the tubular unit part.

9. A downhole completion system according to claim 8, further comprising an end cap having apertures and being connected to the unit housing.

10. A downhole completion system according to claim 8 or 9, wherein the unit housing comprises a projection on an inner face for receiving a flange of the tubular unit part in order that the tubular unit part is hindered from movement past the projection.

11. A downhole completion system according to claim 8, wherein the tubular unit part is mounted within the unit housing.

12. A downhole completion system according to claim 1, wherein the at least one second opening has a diameter smaller than that of the at least one first opening.

13. A downhole completion system according to claim 1, wherein the sliding sleeve has a first sleeve part having a first inner sleeve diameter and a second sleeve part having a second inner sleeve diameter, the tubular unit part has a first unit section having a first outer diameter corresponding to the first inner sleeve diameter and a second unit section of the tubular unit part has a second outer diameter corresponding to the second inner sleeve diameter.

14. A downhole completion system according to claim 1, wherein the tubular unit part has a decreasing inner diameter at the first unit end for guiding a ball towards the ball seat.

15. A completion closing unit for being mounted as part of a second end of a well tubular metal structure having a first end closer to a top of the well than the second end and for in a first position to allow flow downhole through the second end of the well tubular metal structure and in a second position to close the second end, the closing unit comprises:

a tubular unit part having a first unit end being open and a second unit end being closed, a sliding sleeve arranged around an outer face of the tubular unit part defining a chamber there between, the sliding sleeve is able to slide between the first position and the second position, at least one first opening in the tubular unit part, at least one second opening in the tubular unit part opposite the chamber, the at least one second opening is arranged closer to the first unit end than the at least one first opening, and a ball seat arranged in the tubular unit part between the at least one first opening and the at least one second opening.

* * * * *